US007032832B2

(12) United States Patent
Kassanits

(10) Patent No.: US 7,032,832 B2
(45) Date of Patent: Apr. 25, 2006

(54) ASYMMETRICAL SPRAY NOZZLE WITH ALIGNMENT NOTCH

(75) Inventor: Richard Kassanits, West Chicago, IL (US)

(73) Assignee: Spraying Systems Co., Wheaton, IL (US)

( * ) Notice: Subject to any disclaimer, the term of this patent is extended or adjusted under 35 U.S.C. 154(b) by 216 days.

(21) Appl. No.: 10/737,015

(22) Filed: Dec. 16, 2003

(65) Prior Publication Data

US 2005/0127212 A1 Jun. 16, 2005

(51) Int. Cl.
*B67D 5/08* (2006.01)

(52) U.S. Cl. ..... 239/71; 239/597; 239/598; 239/599; 239/600

(58) Field of Classification Search ..... 239/71, 239/390, 597, 598, 599, 600
See application file for complete search history.

(56) References Cited

U.S. PATENT DOCUMENTS

| | | | | |
|---|---|---|---|---|
| 2,619,388 | A | 11/1952 | Wahlin | |
| 2,683,626 | A | 7/1954 | Wahlin | |
| 2,774,631 | A | 12/1956 | Wahlin | |
| 2,778,687 | A | 1/1957 | Hegstad | |
| 2,778,688 | A | 1/1957 | Corl | |
| 2,964,248 | A | 12/1960 | O'Brien et al. | |
| 2,971,250 | A | 2/1961 | Wahlin | |
| 3,697,313 | A | 10/1972 | Stumphauzer et al. | |
| 3,737,108 | A | 6/1973 | Stumphauzer et al. | |
| 3,843,055 | A | 10/1974 | Nord et al. | |
| 4,050,633 | A * | 9/1977 | Courson | 239/600 |
| 4,346,849 | A | 8/1982 | Rood | |
| 4,708,292 | A * | 11/1987 | Gammons | 239/600 |
| 6,592,058 | B1 | 7/2003 | Kassanits | |

OTHER PUBLICATIONS

Picture of Spraying Systems Spray Nozzle, available prior to Dec. 16, 2003.
Picture of Nordson Spray Nozzle, available prior to Dec. 16, 2003.

* cited by examiner

*Primary Examiner*—Steven J. Ganey
(74) *Attorney, Agent, or Firm*—Leydig, Voit & Mayer, .Ltd.

(57) ABSTRACT

A spraying system is provided including a spray gun and a spray nozzle. The spray gun has a discharge end. A locating pin is arranged on the discharge end of the spray gun. The spray nozzle is selectively mountable on the discharge end of the spray gun. The spray nozzle has a discharge orifice configured to produce a asymmetrically distributed fluid discharge pattern wherein the location of maximum fluid discharge is offset from the center of the fluid discharge pattern. The spray nozzle has an alignment notch extending along an outer surface of the spray nozzle. The locating pin is arranged on the spray gun and the alignment notch is arranged on the spray nozzle such that when the spray nozzle is mounted on the discharge end of the spray gun in a predetermined orientation the locating pin extends into the alignment slot.

21 Claims, 4 Drawing Sheets

ASYMMETRICAL SPRAY NOZZLE WITH ALIGNMENT NOTCH

FIELD OF THE INVENTION

This invention pertains to spray nozzles and more particularly to spray nozzles which produce an asymmetrical distribution of the fluid discharge.

BACKGROUND OF THE INVENTION

In order to protect substances such as food and beverages from contamination, a coating is typically applied to the inside surfaces of containers in which such substances are stored. This coating prevents the contents of the container from coming into direct contact with the bare metal or plastic interior surfaces of the container. With standard cylindrical containers or cans, this coating is generally applied to the interior of the container before the top is affixed through the use of a spray nozzle which is arranged to discharge through the open end of the container. As the coating is being discharged from the nozzle, the container is rotated about its longitudinal axis so as to ensure that all of the interior surfaces are coated.

The coating material used on the inside surfaces of the containers represents one of the most significant costs associated with a container manufacturing operation. To help achieve an even coating, the coating material is generally applied using spray nozzles that are configured to produce an asymmetrical distribution of the fluid discharge. In particular, the nozzles generally produce a fan-shaped discharge pattern with a maximum amount of fluid being discharged at a point offset from the center of the spray pattern and with the level or amount of discharge tapering from the location of maximum discharge to either end of the spray pattern. These nozzles are arranged at an angle relative to the longitudinal axis of the container so that the heaviest portion of the discharge is directed towards the far, closed end of the container. Thus, the asymmetrical distribution helps compensate for the greater distance the coating material must travel to reach the closed end of the container and, in turn, the greater surface area of the interior of the container that this portion of the discharge pattern must cover.

Because of the asymmetrical distribution of the fluid discharge, the spray nozzles must be arranged in a specific orientation relative to the containers to achieve the desired even coating of the interior of the containers. If the orientation of the spray nozzles is incorrect, the containers will not be properly coated. A container coating operation typically is highly automated. Thus, when one or more of the spray nozzles applying the coating is installed incorrectly, a significant amount of time may elapse before the problem is discovered. Because a container coating operation also runs at a very high speed, thousands of containers may be coated improperly during this time. Once the alignment problem with the spray nozzles is corrected, the defective containers then have to be collected and recoated. Obviously, this is an expensive and time consuming process.

Currently, the standard practice for indicating the proper alignment of the spray nozzle is to place an arrow on the body of the nozzle. However, in a container coating operation, a build-up of the container coating material can quickly form on the spray nozzles. This build-up can obscure the arrow on the nozzle body making it difficult to determine if the nozzle is installed properly.

BRIEF SUMMARY OF THE INVENTION

A spray nozzle is provided which includes a nozzle body and a spray tip. The spray tip has a discharge orifice configured to produce a asymmetrically distributed fluid discharge pattern wherein the location of maximum fluid discharge is offset from the center of the fluid discharge pattern. The nozzle body includes an alignment notch extending in a longitudinal direction of the spray nozzle along an outer surface of the nozzle body. The alignment notch is arranged in a predetermined orientation relative to the discharge orifice.

A spraying system is also provided including a spray gun and a spray nozzle. The spray gun has a discharge end. A locating pin is arranged on the discharge end of the spray gun. The spray nozzle is selectively mountable on the discharge end of the spray gun. The spray nozzle has a discharge orifice configured to produce a asymmetrically distributed fluid discharge pattern wherein the location of maximum fluid discharge is offset from the center of the fluid discharge pattern. The spray nozzle has an alignment notch extending along an outer surface of the spray nozzle. The locating pin is arranged on the spray gun and the alignment notch is arranged on the spray nozzle such that when the spray nozzle is mounted on the discharge end of the spray gun in a predetermined orientation the locating pin extends into the alignment slot.

DETAILED DESCRIPTION OF THE INVENTION

Figure 1:
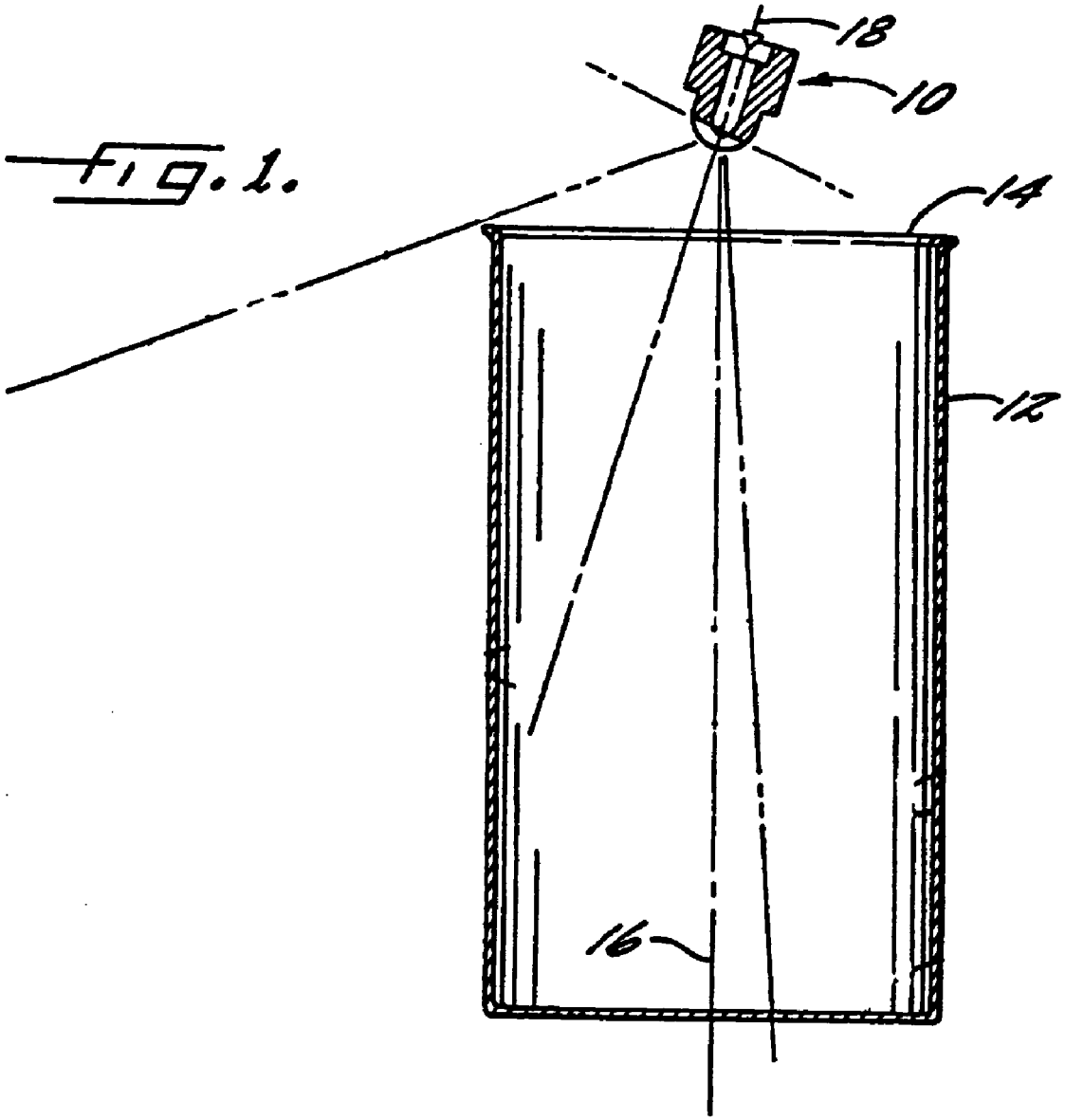
FIG. 1 is a schematic longitudinal section view of a container coating station incorporating an illustrative spray nozzle for producing an asymmetrical fluid discharge distribution pattern embodying the present invention.

Referring now more particularly to FIG. 1, there is schematically shown, a portion of an exemplary container coating station that includes a spray nozzle 10 embodying the present invention which discharges, in this case, a coating material fluid in an asymmetrically distributed pattern. With the illustrated container coating station, open-ended containers 12 are indexed one-by-one to the coating station where the stationary spray nozzle 10 applies a coating material onto the interior surfaces of the container 12 through the open end 14. The spray nozzle is attached to a spray gun 15 (not shown in FIG. 1) that, in turn, is connected to a supply of the coating material. The coating material may comprise vinyl, epoxy, acrylic or other suitable materials. As the coating material is being applied, the container 12 is rotated about its longitudinal axis 16 relative to the spray nozzle 10 at a relatively high speed (e.g., 500–3000 rpm) so that the coating material is applied to the entire interior of the container. As will be understood by those skilled in the art, while the spray nozzle of the present invention is described in connection with a container coating application, it may be employed in other applications and systems where an asymmetrical fluid discharge pattern is desired.

To facilitate application of the coating material, the spray nozzle 10 is disposed on the longitudinal axis 16 of the container 12 a short distance from the open end 14 of the container as shown in FIG. 1. Additionally, the spray nozzle 10 is canted such that the centerline 18 of the nozzle is disposed at an angle θ relative to the longitudinal axis 16 of the container, which, in this case, is oriented substantially horizontal. To compensate for the greater distance the coating material must travel to reach the closed end of the container 12, the spray nozzle 10 is arranged so that the portion of the spray pattern with the heaviest discharge is directed generally towards the intersection of the bottom wall and cylindrical sidewall of the container. As will be appreciated by those skilled in the art, the angle θ of the spray nozzle 10 relative to the longitudinal axis 16 of the container can vary depending on the configuration of the container 12 being coated. In most instances, however, the spray nozzle 10 is preferably arranged at an angle θ of approximately 5° to 20° relative to the longitudinal axis 16 of the container.

Figure 2:
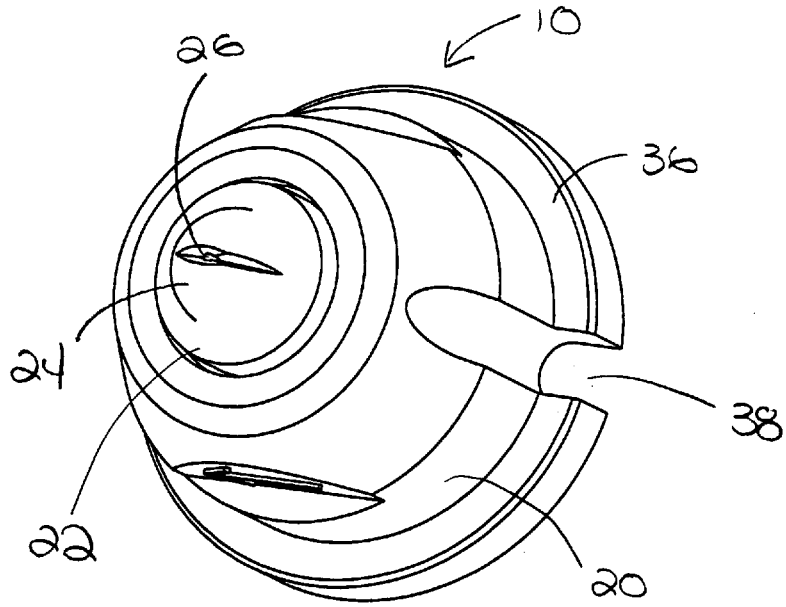
FIG. 2 is an enlarged perspective view of the illustrative asymmetric distribution spray nozzle of FIG. 1 showing the alignment notch.
Figure 6:
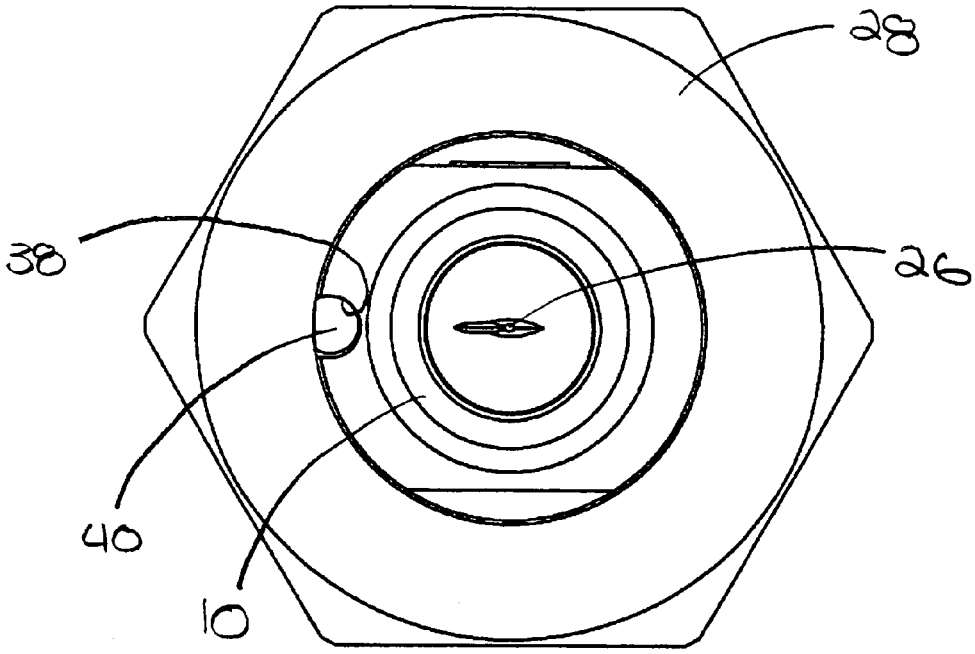
FIG. 6 is a front view of the illustrative asymmetric distribution spray nozzle secured on the end of the spray gun by the retaining nut.
Figure 7:
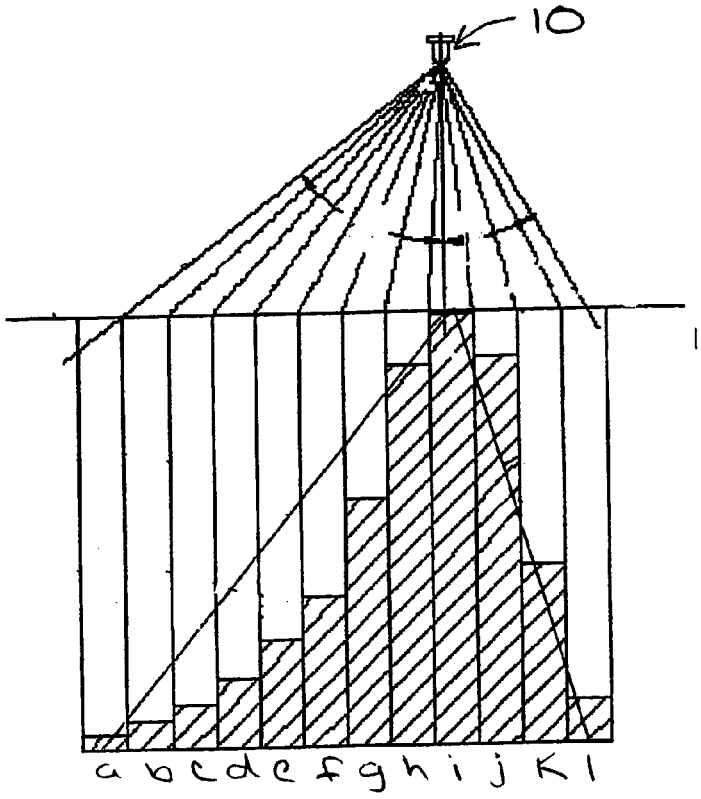
FIG. 7 is a schematic drawing showing an exemplary asymmetric fluid discharge pattern for the illustrative spray nozzle for a container coating operation.

In the illustrated embodiment, the spray nozzle 10 includes a nozzle body 20 and a spray tip 22 having a dome shaped end wall 24 with a discharge orifice 26 formed therein, as best shown in FIGS. 2 and 6. The discharge orifice 26 has an irregular shape that is configured to produce a spray pattern having the desired asymmetrical distribution of the fluid discharge. In this case, the discharge orifice 26 of the spray nozzle 10 is configured so as to produce a flat fan shaped pattern in which the heaviest discharge is shifted from the center towards one end of the fan pattern. One preferred distribution pattern for the spray nozzle 10 is schematically shown in FIG. 7. In FIG. 7, the amount of flow at different points in the spray pattern or fan is illustrated by the shaded areas in the troughs a–l. With this distribution pattern, the maximum amount of fluid is discharged at a point (trough i in the illustrated embodiment) approximately midway from the center and one end of the fan. From the point of maximum discharge, the amount of fluid discharged tapers in a non-linear manner to minimum discharge points at either end of the spray fan (trough a and trough l in FIG. 7). Additional details regarding how the discharge orifice can be configured to produce an improved fluid discharge pattern for container coating applications are provided in commonly owned U.S. Pat. No. 6,592,058 and U.S. patent application Ser. No. 09/967,417 the disclosures of which are incorporated herein by reference.

As will be appreciated by those skilled in the art, the present invention is not limited to spray nozzles that produce any particular fluid discharge pattern. For example, instead of the non-linear taper shown in FIG. 7, the discharge orifice 26 of the spray nozzle 10 could be configured to produce a discharge pattern in which the amount of discharge tapers linearly from the location of maximum discharge to either end of the spray pattern. The spray nozzle 10 could also be configured to produce a spray pattern in which the location of maximum discharge is located at or near one end of the spray pattern with the amount of discharge tapering to the other end of the discharge pattern.

Figure 3:
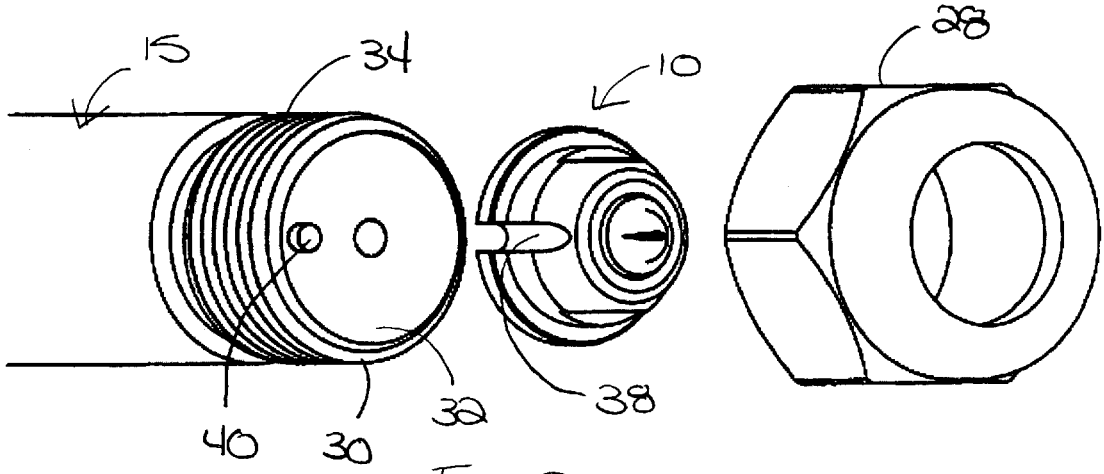
FIG. 3 is an exploded perspective view of the illustrative asymmetric distribution spray nozzle and an end of an illustrative spray gun having a complementary locating pin.

In the illustrated embodiment, the spray nozzle 10 can be attached to the spray gun 15 using a retaining member 28, in this case a retaining nut. More specifically, as shown in FIG. 3, the spray gun 15 includes a discharge end or tip 30 having a mounting surface 32 for receiving the spray nozzle 10. As shown in FIG. 3, the stem 34 of the end of the spray gun 15 is threaded so that when the spray nozzle 10 is arranged in position on the discharge end 30 of the spray gun 15, the spray nozzle 10 can be secured in place via the retaining nut 28 (see FIGS. 4 and 5). In this case, the retaining nut 28 captures a flange 36 at the inlet end of the spray nozzle 10 so as to hold the spray nozzle on the spray gun 15.

In order to help ensure that the spray nozzle 10 is oriented properly with respect to the objects being sprayed, in this case the containers, the spray nozzle 10 has an alignment notch 38 arranged in a predetermined position relative to the discharge orifice 26. The alignment notch 38 provides a visual indicator that an installer can use to ensure that the spray nozzle 10 is installed in the proper orientation on the spray guns. In particular, the alignment notch 38 can be positioned such that when the spray nozzle 10 is installed properly on a spray gun, the alignment notch faces a given direction. Moreover, the predetermined position of the alignment notch 38 relative to the discharge orifice 26 can be the same for a group of spray nozzles such that when installed properly the alignment notches of the group of nozzles all face the same direction. As will be appreciated, this makes it easy for an installer to install the spray nozzles very quickly and accurately.

Figure 4:
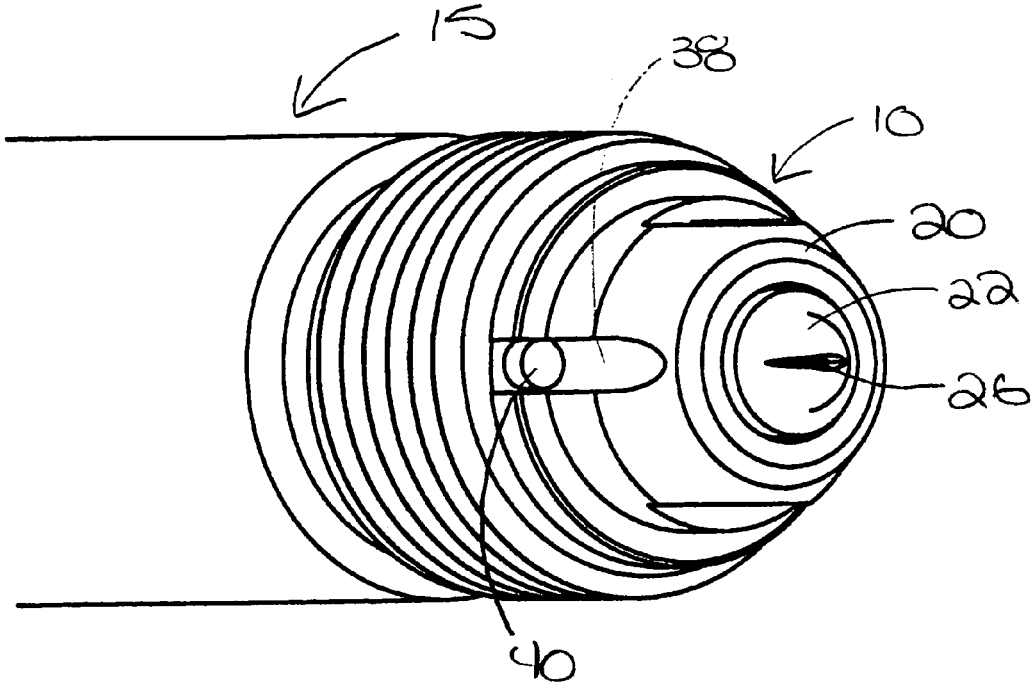
FIG. 4 is a perspective view of the illustrative asymmetric distribution spray nozzle arranged on the end of the spray gun of FIG. 3.
Figure 5:
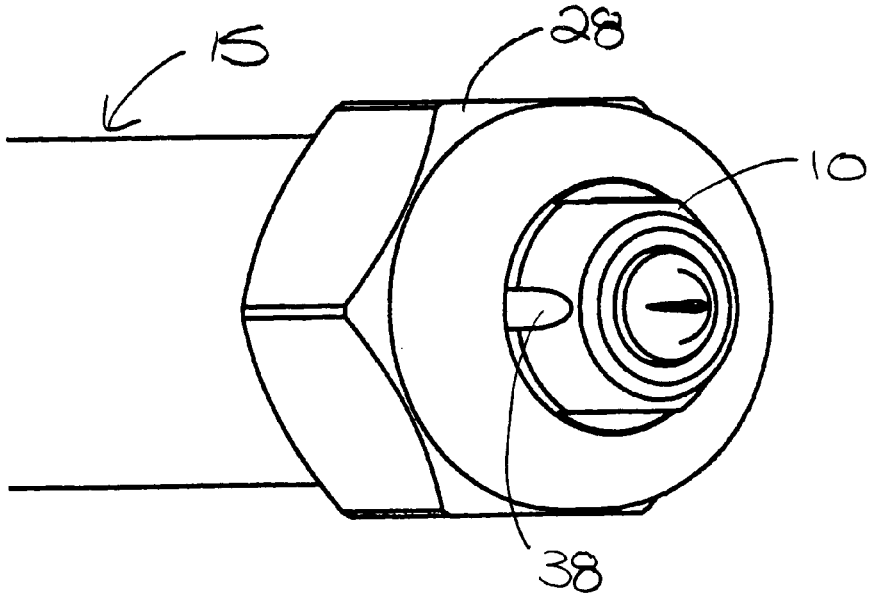
FIG. 5 is a perspective view of the illustrative asymmetric distribution spray nozzle secured on the end of the spray gun by a retaining nut.

In the illustrated embodiment, the alignment notch 38 extends in a longitudinal direction along the outer surface of the side of the nozzle body 20 (see, e.g., FIGS. 2 and 4). The illustrated alignment notch 38 extends along a substantial portion of the length of the nozzle body 20, in this case a majority (i.e., over one half) of the length, and cuts relatively deeply into the surface of the nozzle body. Thus, unlike an arrow, the alignment notch 38 provides a prominent structural feature that will not become obscured by a build-up of coating material on the spray nozzle 10.

To prevent the spray nozzle 10 from being installed out of alignment, the spray gun 15 can be equipped with a locating pin 40 that is received in the alignment notch 38 when the spray nozzle 10 is properly installed on the spray gun 15. In the illustrated embodiment, the locating pin 40 extends outward from the mounting surface 32 on the discharge end 30 of the spray gun (see, e.g., FIGS. 3 and 4). Moreover, so as to be able to receive the locating pin 40, the alignment notch 38 extends through the retaining flange 36 at the inlet end of the spray nozzle 10. The locating pin 40 is arranged on the spray nozzle 10 in a predetermined position, for example relative to the objects being sprayed, such that when the nozzle is positioned on the discharge end 30 of the spray gun 15 in the proper orientation, the locating pin 40 extends into the alignment notch 38 as shown in FIGS. 4 and 6. If the spray nozzle 10 is not oriented properly, the alignment notch 38 and the locating pin 40 will be misaligned and the installer will not be able to attach the spray nozzle 10 to the spray gun 15. Thus, the locating pin 40 ensures that the spray nozzle 10 can only be installed in the proper orientation.

From the foregoing, it can be seen that the asymmetric discharge spray nozzle of the present invention allows an installer to determine quickly and easily whether the nozzle is installed in the proper orientation relative to the objects being sprayed. This helps reduce or eliminate errors in the installation of such spray nozzles that can be costly and time consuming to correct. Moreover, if the asymmetric spray nozzle of the present invention is utilized with a spray gun having a locating pin according to another aspect of the present invention, the possibility of the spray nozzle being installed in the wrong orientation can be even further reduced if not eliminated.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context

What is claimed is:

1. A spraying system for discharging a flat spray pattern comprising:

a spray gun having a discharge end, a locating pin being arranged on the discharge end of the spray gun; and a spray nozzle selectively mountable on the discharge end of the spray gun, the spray nozzle having a discharge orifice configured to produce a flat fluid discharge spray pattern said spray nozzle having an alignment notch extending along an outer surface of the spray nozzle, said locating pin being arranged on the spray gun and the alignment notch is being arranged on the spray nozzle such that when the spray nozzle is mounted on the discharge end of the spray gun in a predetermined orientation the locating pin extends into the alignment notch and the alignment notch provides an external visual observation to a user of the spray gun of the orientation of a flat spray pattern to be discharged from the spray nozzle during usage of the spray gun.

2. The spraying system according to claim 1 wherein the alignment notch extends a majority of the length of the spray nozzle.

3. The spraying system according to claim 1 further including a retaining element for securing the spray nozzle to the discharge end of the spray gun.

4. The spraying system according to claim 3 wherein the spray nozzle includes a retaining flange at an inlet end thereof which is engaged by the retaining member when the spray nozzle is secured on the discharge end of the spray gun by the retaining member.

5. The spraying system according to claim 4 wherein the alignment notch extends through the retaining flange on the spray nozzle.

6. The spraying system according to claim 1 wherein the alignment notch extends in a longitudinal direction of the spray nozzle.

7. The spraying system according to claim 6 wherein the alignment notch extends to an inlet end of the spray nozzle.

8. The spray nozzle according to claim 7 wherein the alignment notch extends a majority of the length of the spray nozzle.

9. The spraying system of claim 1 in which said spray nozzle discharge orifice is configured to produce an asymmetrically distributed flat fluid discharge spray pattern wherein the location of the maximum fluid discharge is offset from the center of the fluid discharge pattern.

10. The spraying system of claim 1 in which said spray nozzle discharge orifice is defined by an elongated cross slot extending transversely across the end of the spray nozzle.

11. A spray nozzle comprising a nozzle body and a spray tip, the spray tip including a discharge orifice configured to produce a a flat fluid discharge spray pattern said nozzle body having an alignment notch extending in a longitudinal direction of the spray nozzle along an outer surface of the nozzle body, said alignment notch being arranged in a predetermined orientation relative to the discharge orifice for providing an external visual observation to a user of the spray nozzle of the orientation of a flat spray pattern to be discharged from the spray nozzle.

12. The spray nozzle according to claim 11 wherein the alignment notch extends to an inlet end of the spray nozzle.

13. The spray nozzle of claim 11 in which said spray nozzle discharge orifice is configured to produce an asymmetrically distributed flat fluid discharge spray pattern wherein the location of the maximum fluid discharge is offset from the center of the fluid discharge pattern.

14. The spray nozzle of claim 11 in which said spray nozzle discharge orifice is defined as elongated cross slot extending transversely across the end of the spray nozzle.

15. A spraying system comprising:

a spray gun having a discharge end, a locating pin being arranged on the discharge end of the spray gun; and a spray nozzle selectively mountable on the discharge end of the spray gun, the spray nozzle having a discharge orifice configured to produce a asymmetrically distributed fluid discharge pattern wherein the location of maximum fluid discharge is offset from the center of the fluid discharge pattern, the spray nozzle having an alignment notch extending along an outer surface of the spray nozzle a majority of the length of the spray nozzle, wherein the locating pin is arranged on the spray gun and the alignment notch is arranged on the spray nozzle such that when the spray nozzle is mounted on the discharge end of the spray gun in a predetermined orientation the locating pin extends into the alignment slot.

16. A spraying system comprising:

a spray gun having a discharge end, a locating pin being arranged on the discharge end of the spray gun; and a spray nozzle selectively mountable on the discharge end of the spray gun, the spray nozzle having a discharge orifice configured to produce a asymmetrically distributed fluid discharge pattern wherein the location of maximum fluid discharge is offset from the center of the fluid discharge pattern, the spray nozzle having an alignment notch extending along an outer surface of the spray nozzle to an inlet end of the spray nozzle, wherein the locating pin is arranged on the spray gun and the alignment notch is arranged on the spray nozzle such that when the spray nozzle is mounted on the discharge end of the spray gun in a predetermined orientation the locating pin extends into the alignment slot.

17. A spray nozzle comprising a nozzle body and a spray tip, the spray tip including a discharge orifice configured to produce a asymmetrically distributed fluid discharge pattern wherein the location of maximum fluid discharge is offset from the center of the fluid discharge pattern, the nozzle body having an alignment notch extending in a longitudinal direction of the spray nozzle along an outer surface of the nozzle body a majority of the length of the spray nozzle, the alignment notch being arranged in a predetermined orientation relative to the discharge orifice.

18. A spray nozzle comprising a nozzle body and a spray tip, the spray tip including a discharge orifice configured to produce a asymmetrically distributed fluid discharge pattern wherein the location of maximum fluid discharge is offset from the center of the fluid discharge pattern, the nozzle body having an alignment notch extending in a longitudinal direction of the spray nozzle along an outer surface of the nozzle body to an inlet end of the spray nozzle, the alignment notch being arranged in a predetermined orientation relative to the discharge orifice.

19. A spray nozzle comprising a nozzle body and a spray tip, the spray tip including a discharge orifice formed in a front end of said nozzle configured to produce a flat fluid discharge spray pattern said nozzle body being formed with an alignment recess extending into said nozzle body and visible from a front end of said nozzle body, said alignment recess being arranged in predetermined orientation relative to the discharge orifice for providing an external visual observation to a user of the spray nozzle of the orientation of a flat spray pattern to be discharged from the spray nozzle discharge orifice.

20. The spray nozzle of claim 19 in which said spray nozzle discharge orifice is defined by an elongated cross slot extending across the end of said spray nozzle.

21. The spray nozzle of claim 19 in which said spray nozzle discharge orifice is configured to produce an asymmetrically distributed flat liquid spray discharge pattern wherein the location of the maximum fluid discharge is offset from the center of the fluid discharge pattern.

* * * * *